US006990828B2

(12) United States Patent
Kim et al.

(10) Patent No.: US 6,990,828 B2
(45) Date of Patent: Jan. 31, 2006

(54) REFRIGERATOR

(75) Inventors: Yoon-young Kim, Suwon (KR); Gun-ho Hong, Kwanglu (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 10/645,845

(22) Filed: Aug. 22, 2003

(65) Prior Publication Data

US 2004/0118141 A1 Jun. 24, 2004

(30) Foreign Application Priority Data

Aug. 24, 2002 (KR) ..... 10-2002-0050352
Dec. 9, 2002 (KR) ..... 10-2002-0077760

(51) Int. Cl.
*F25D 25/02* (2006.01)

(52) U.S. Cl. ..... 62/381; 62/255; 62/440; 312/125; 312/135; 312/305

(58) Field of Classification Search ..... 62/381, 62/255, 314, 414, 419, 440, 441, 298, 407, 62/408; 312/125, 135, 305
See application file for complete search history.

(56) References Cited

FOREIGN PATENT DOCUMENTS

| | | |
|---|---|---|
| JP | 4-292765 | 9/2001 |
| KR | 1996-5025 | 2/1996 |
| KR | 1997-47538 | 7/1997 |
| KR | 118040 | 2/1998 |
| KR | 1998-15249 | 6/1998 |
| KR | 136047 | 11/1998 |
| KR | 1999-9012 | 3/1999 |
| KR | 1999-12949 | 4/1999 |
| KR | 00236481 B1 | 10/1999 |
| KR | 20-192841 | 6/2000 |
| KR | 10-292188 | 3/2001 |
| KR | 10-311369 | 9/2001 |

*Primary Examiner*—William E. Tapolcai
*Assistant Examiner*—Mohammad M. Ali
(74) *Attorney, Agent, or Firm*—Staas & Halsey LLP

(57) ABSTRACT

A refrigerator comprises a cool air generating part supplying cool air to a storage compartment; upper and lower cabinets having first and second storage compartments; and a shaft rotatably supporting the upper and lower cabinets, respectively. With this configuration, the refrigerator is useable in all directions by a rotatable structure, is easily carried by wheels, and is useable as a table by a table member provided in an upper part of an upper cabinet.

36 Claims, 7 Drawing Sheets

REFRIGERATOR

CROSS-REFERENCE TO RELATED APPLICATION

This application claims the benefit of Korean Patent Application Nos. 2002-50352, filed Aug. 24, 2002 and 2002-77760, filed Dec. 9, 2002 in the Korean Intellectual Property Office, the disclosure of which is incorporated herein by reference.

BACKGROUND OF THE INVENTION

1. Field of the Invention

The present invention relates to a refrigerator, and more particularly, to a refrigerator improved in a rotatable structure of a storage compartment.

2. Description of the Related Art

Generally, a refrigerator comprises a cabinet forming a storage compartment such as a freezer compartment and a refrigerator compartment, a cool air generator provided inside the cabinet and generating cool air, and a door opening and closing the storage compartment.

The cool air generator uses mainly a refrigeration cycle including a compressor, an evaporator, etc., and a thermoelectric semiconductor element so as to generate the cool air.

The refrigeration cycle comprises the compressor compressing a gaseous refrigerant into a high-temperature and high-pressure gaseous refrigerant, a condenser condensing the compressed gaseous refrigerant into a liquid refrigerant, a capillary tube converting the liquid refrigerant into a low-temperature and low-pressure liquid refrigerant, and the evaporator evaporating the low-temperature and low-pressure liquid refrigerant so as to absorb latent heat of vaporization from a circumference of the evaporator, thereby generating the cool air.

The thermoelectric semiconductor element uses a thermoelectric phenomenon that generates and absorbs heat besides Joule heat according to a current direction when an electric current flows in a contact surface of a semiconductor material and a metal material. In the thermoelectric semiconductor element, an exothermic amount or an endothermic amount is adjustable according to a current intensity, and an exothermic direction and an endothermic direction are changeable according to a direction of a current flow. Further the thermoelectric semiconductor element has no mechanical parts so that the thermoelectric semiconductor element occupies a small space and operates without noise.

The thermoelectric semiconductor element is used in a refrigerator for a vehicle and in a refrigerator to store cosmetics, etc., as well as in a refrigerator to store food.

However, in a conventional refrigerator, the door opening and closing the storage compartment is provided in a predetermined direction, so that the refrigerator is inconvenient to use by a user situated in another direction.

Further, the conventional refrigerator is seated in a predetermined space such as a kitchen, the vehicle, etc., so that to carry the refrigerator is difficult.

Further, an upper surface of the conventional refrigerator is not effectively used.

SUMMARY OF THE INVENTION

Accordingly, it is an aspect of the present invention to provide a refrigerator which can be used in all directions.

It is another aspect to provide a refrigerator which can be easily carried and be used as a table.

Additional aspects and/or advantages of the invention will be set forth in part in the description which follows and, in part, will be obvious form the description, or may be learned by practice of the invention.

The above and/or other aspects are achieved by providing a refrigerator comprising a cool air generating part supplying cool air to storage compartments of upper and lower cabinets; the upper and lower cabinets being adjacent to each other and each having at least one storage compartment; and a shaft rotatably supporting the upper and lower cabinets, respectively.

The refrigerator further comprises a table member provided on an upper part of the upper cabinet.

The table member may be rotatable relative to the upper cabinet.

The table member may be rotatably combined to the shaft.

The refrigerator may further comprise a base member disposed under the lower cabinet and supporting the shaft.

The cool air generating part may be provided inside the base member, and the shaft may include a cool air supplying passage extended to the storage compartment of each of the cabinets, communicating with the cool air generating part, and supplying the cool air generated by the cool air generating part to the storage compartment, and a storage air exhausting passage exhausting air in the storage compartment of each of the cabinets to the cool air generating part.

The shaft may include a first pipe, and a second pipe coaxially provided around the first pipe and spaced from each other, and one of the cool air supplying passages and the storage air exhausting passages corresponding to the upper and lower cabinets, respectively, is formed inside of the first pipe, and a remaining one of the cool air supplying passages and the storage air exhausting passages is formed between the first pipe and the second pipe.

The shaft may include a cool air supplying outlet formed through the first pipe and the second pipe to communicate with each storage compartment and supplying the cool air into each storage compartment; and a storage air exhausting outlet formed on a side of the second pipe.

The upper cabinet may be provided with a viewing window on an upper surface thereof so as to show an inside of the storage compartment; and the table member may be configured such that an inside of the upper cabinet is viewable through the viewing window.

The refrigerator may further comprise a plurality of wheels supporting the base member.

The refrigerator may further comprise at least one middle cabinet provided between the upper and lower cabinets.

The cool air generating part may include a thermoelectric semiconductor element provided in at least one of the cabinets.

According to another aspect of the present invention, the foregoing] The above and/or other aspects may be achieved by providing a refrigerator comprising a cool air generating part supplying cool air to a storage compartment; a cabinet forming the storage compartment; a shaft rotatably supporting the cabinet; a table member provided in an upper surface of the cabinet; and a plurality of wheels supporting the cabinet.

The refrigerator may further comprise a base member provided between the cabinet and the wheels.

The table member may be rotatable relative to the cabinet.

The cool air generating part may be provided inside the base member, and the shaft may include a cool air supplying passage and may extend to the storage compartment of the cabinet, communicating with the cool air generating part, and supplying the cool air generated by the cool air generating part to the storage compartment, and a storage air exhausting passage may exhaust air in the storage compartment to the cool air generating part.

The cabinet may be provided with a viewing window on an upper surface thereof so as to show an inside of the storage compartment; and the table member may be configured such that an inside of the cabinet is viewable through the viewing window.

The cool air generating part may include a thermoelectric semiconductor element provided inside the cabinet.

BRIEF DESCRIPTION OF THE DRAWINGS

These and/or other aspects and advantages of the present invention will become apparent and more readily appreciated from the following description of the embodiments, taken in conjunction with the accompany drawings of which.

DETAILED DESCRIPTION OF THE PREFERRED EMBODIMENTS

Figure 1:
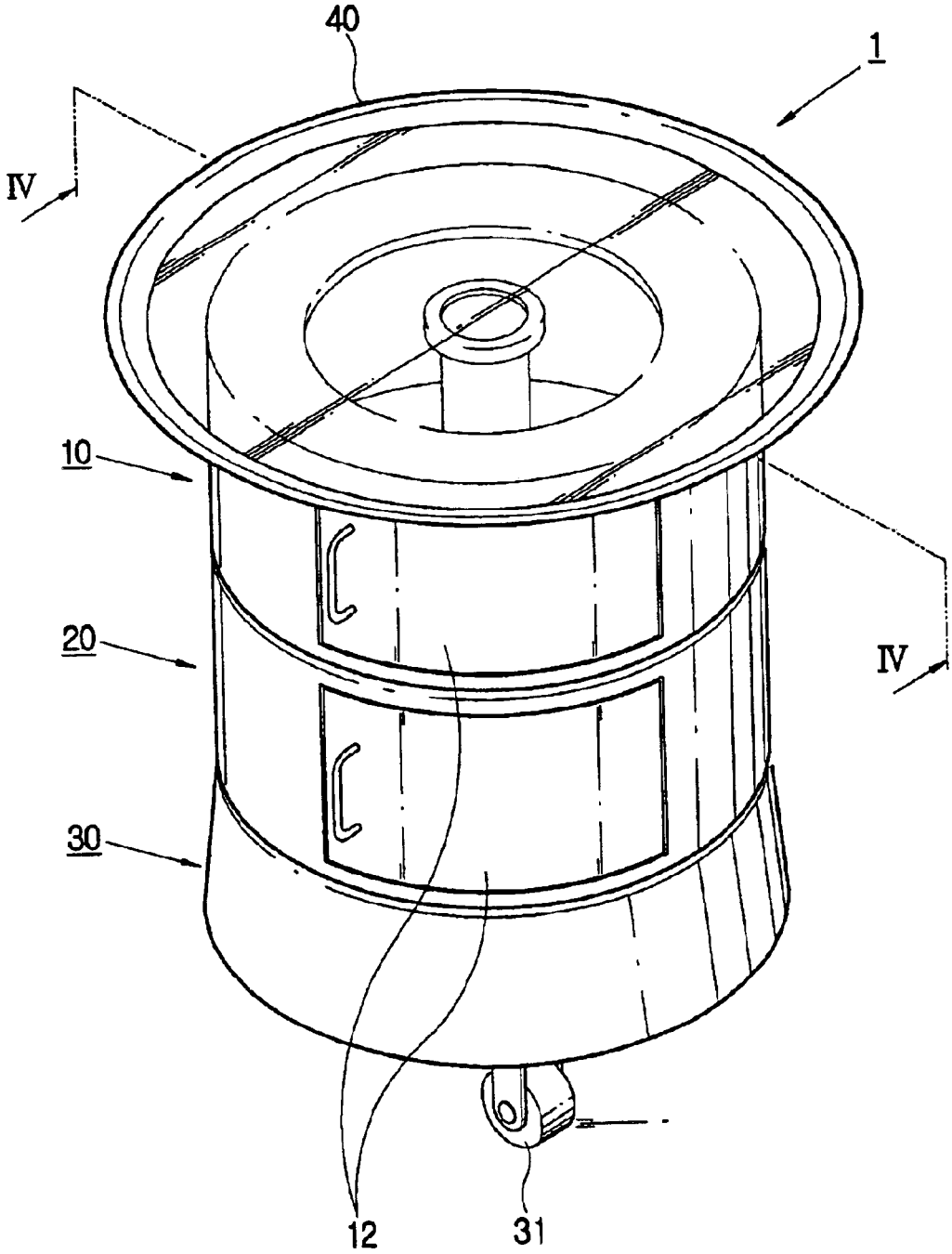
FIG. 1 is a perspective view of a refrigerator according to a first embodiment of the present invention.
Figure 2:
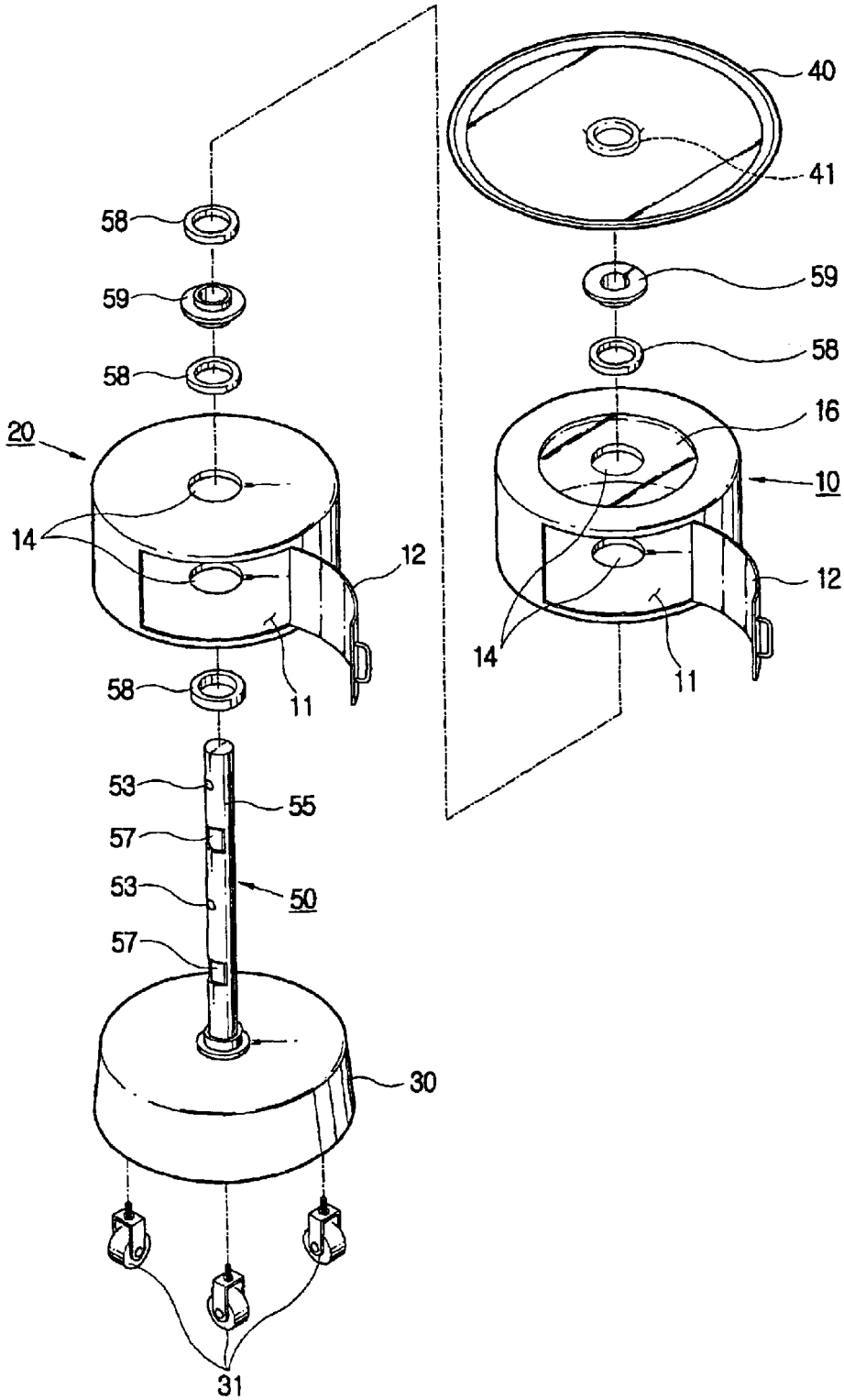
FIG. 2 is an exploded perspective view of the refrigerator of FIG. 1.
Figure 3:
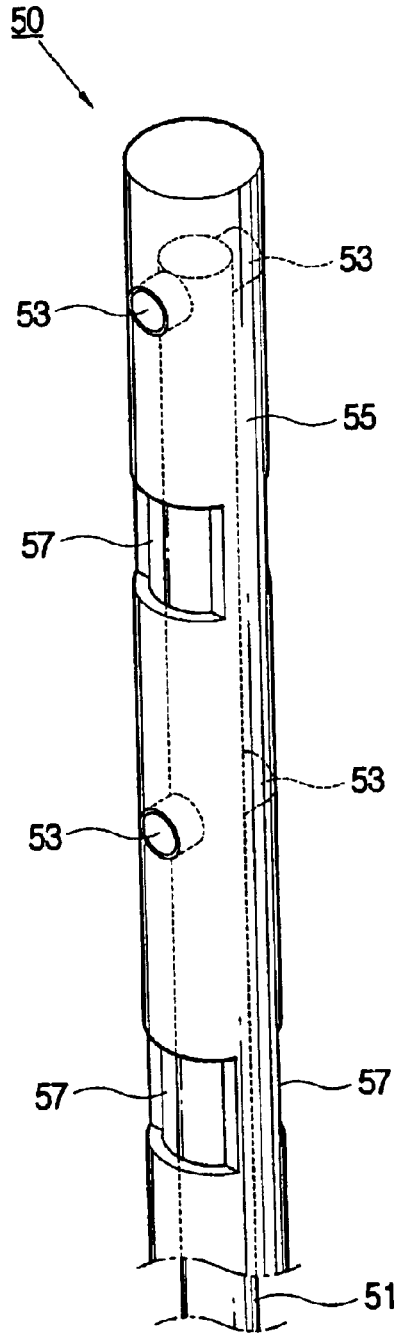
FIG. 3 is a perspective view of a shaft in the refrigerator of FIG. 2.
Figure 4:
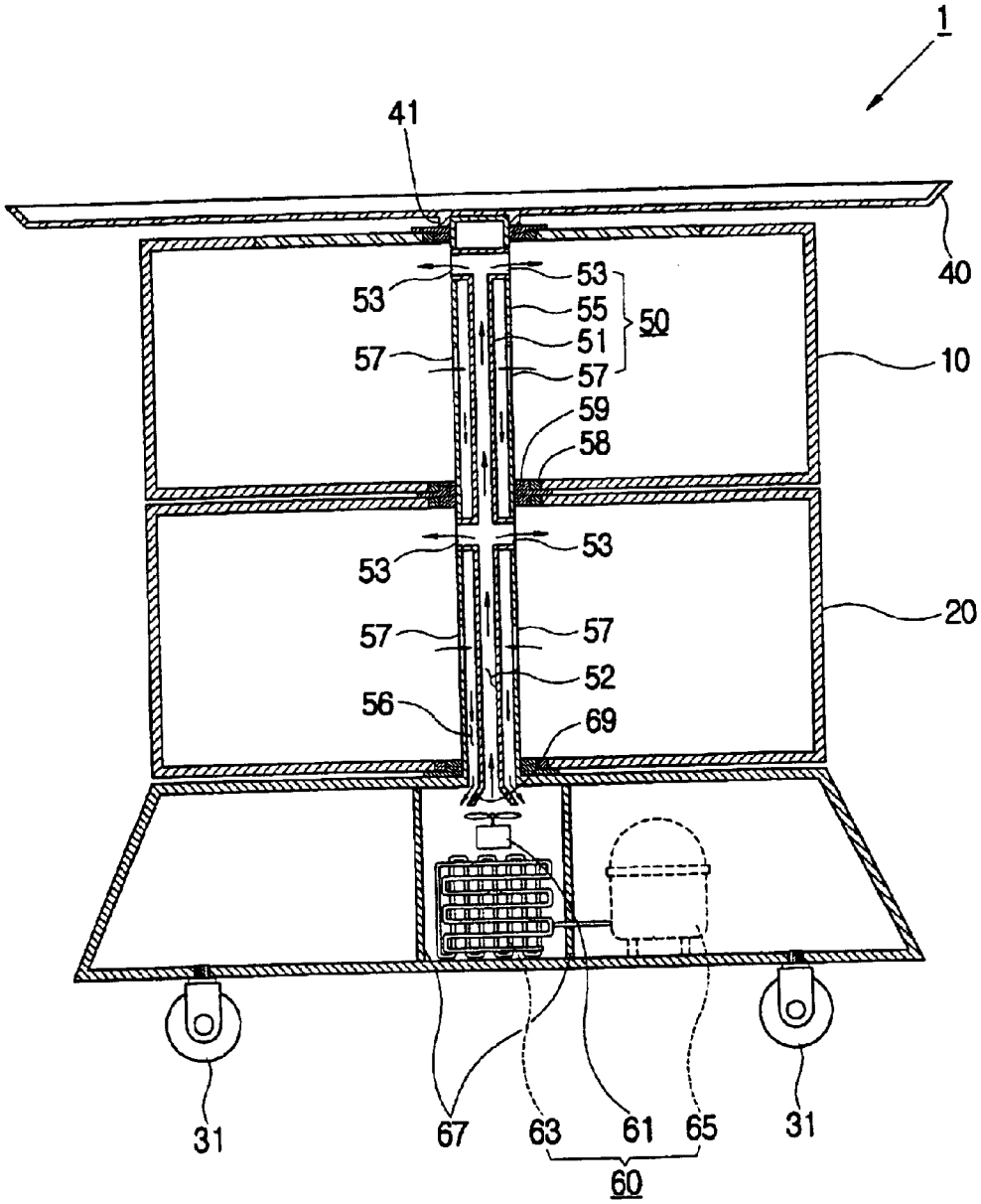
FIG. 4 is a sectional view of the refrigerator, taken along line IV—IV of FIG. 1.

Reference will now be made in detail to the embodiments of the present invention, examples of which are illustrated in the accompanying drawings, wherein like reference numerals refer to like elements throughout. The embodiments are described below in order to explain the present invention by referring to the figures.

As shown in FIGS. 1 through 4, a refrigerator 1 according to a first embodiment of the present invention comprises an upper cabinet 10 and a lower cabinet 20 which are stacked and form a storage compartment 11, such as a freezer compartment, and a refrigerator compartment to store articles of food, cosmetics, etc., a shaft 50 rotatably supporting the upper and lower cabinets 10 and 20, a table member 40 provided on an upper surface of the upper cabinet 10, a base member 30 provided under the lower cabinet 20, and a cool air generating part 60 provided inside the base member 30 and supplying cool air to the storage compartment 11.

The upper and lower cabinets 10 and 20 are in a shape of a cylinder and are provided with doors 12 on a side thereof to rotatably open and close the storage compartment 11. Upper and lower surfaces of both the upper and lower cabinets 10 and 20 are formed with shaft holes 14 to allow the shaft 50 to pass at a center thereof, respectively. Further, the upper surface of the upper cabinet 10 is provided with a viewing window 16 to show an inside of the storage compartment 11 of the upper cabinet 10.

Each of the shaft holes 14 is combined with a bearing 58 and a bushing 59, to smoothly rotate on the shaft 50.

The shaft 50 is accommodated in the shaft holes 14 of the upper and lower cabinets 10 and 20 so as to rotatably support the upper and lower cabinets 10 and 20, and has an upper end rotatably combined to the table member 40 and a lower end combined to the base member 30.

Further, the shaft 50 communicates with the cool air generating part 60 provided inside the base member 30, and includes a first pipe 51 having a cylindrical shape and extending toward the storage compartments 11 of the upper and lower cabinets 10 and 20, and a second pipe 55 coaxially provided around the first pipe 51 and spaced apart from each other. Further, the shaft 50 includes a cool air supplying passage 52 through which the cool air generated from the cool air generating part 60 is supplied to each storage compartment 11, and a storage air exhausting passage 56 through which the air of each storage compartment 11 is drawn into the cool air generating part 60.

The cool air supplying passage 52 is formed inside the first pipe 51, and the storage air exhausting passage 56 is formed between the first pipe 51 and the second pipe 55. Further, a plurality of cool air supplying outlets 53 is formed through the first pipe 51 into each storage compartment 11 through the second pipe 55 so as to supply the cool air from the cool air generating part 60 to each storage compartment 11 via the cool air supplying passage 52. Further, a plurality of storage air exhausting outlets 57 is formed on a side of the second pipe 55 so as to draw the air of each storage compartment 11 in the cool air generator 60 via the storage air exhausting passage 56.

Thus, the cool air is supplied by a cooling fan 61 of the cool air generating part 60 to each of the storage compartments 11 through the cool air supplying passage 52 and the plurality of storage air exhausting outlets 53. The cool air supplied by the cooling fan 61 allows the articles stored in each of the storage compartments 11 to be cool, and the cool air is returned to the cool air generating part 60 through the plurality of storage air exhausting outlets 57 and the storage air exhausting passage 56.

The table member 40 is in a disk-like shape, is larger than the upper surface of the upper cabinet 10, and is formed with a shaft combining part 41 at a bottom center of the shaft combining part 41 to be rotatably combined with an upper end of the shaft 50. The table member 40 is rotatably combined by the shaft combining part 41 with the upper end of the shaft 50 protruding through the upper surface of the upper cabinet 10. Further, the table member 40 is transparent, thereby allowing the articles stored in the storage compartment 11 of the upper cabinet 10 viewed through the viewing window 16 provided on the upper surface of the upper cabinet 10.

The base member 30 is in a cylinder-like shape corresponding to the shape of the upper and lower cabinets 10 and 20, and is provided under the lower cabinet 20, with an upper surface thereof being combined with a lower end of the shaft 50. The base member 30 supports the shaft 50 to rotatably support the upper and lower cabinets 10 and 20 and the table member 40. The base member 30 accommodates the cool air generating part 60 therein to supply the cool air to the upper and lower cabinets 10 and 20. Further, in a bottom of the base member 30 is provided a plurality of wheels 31, thereby facilitating a movement of the refrigerator 1.

The cool air generating part 60 is provided inside the base member 30, and includes a compressor 65, an evaporator 63, etc., forming a refrigeration cycle. The cool air is generated by the refrigeration cycle, and is supplied by the cooling fan 61 to the storage compartments 11 of the upper and lower cabinets 10 and 20 through the first pipe 51 and the cool air supplying passage 52 of the shaft 50 (refer to FIG. 3). Further, the cool air generating part 60 includes a cool air guiding part 69 extending from a lower end of the first pipe 51 toward the cooling fan 61, thereby allowing the cooling fan 61 to effectively blow the cool air around the evaporator 63 into the first pipe 51. Further, the cool air generating part 60 includes a heat-insulating member 67 surrounding the evaporator 63 of the cooling air generating part 60, thereby preventing heat exchange between an outside and the cool air generated in the evaporator 63 and drawn from each of the storage compartments 11.

With this configuration, the refrigerator 1 according to the first embodiment of the present invention is assembled as follows. First, the shaft 50 including the first and second pipes 51 and 55 is combined by screws (not shown) to the upper surface of the base member 30 provided with the cool air generating part 60 and the wheels 31. Further, the base member 30 and the shaft 50 may be formed as a single body, or may be combined by adhesives. Then, the shaft holes 14 of the lower and upper cabinets 20 and 10 are combined with both the bearing 58 and the bushing 59, as first and second assemblies, respectively, and the first and second assemblies, in order, are put on the shaft 50. Further, the shaft combining part 41 of the table member 40 is rotatably combined with the upper end of the shaft 50 protruding through the upper surface of the upper cabinet 10, so that the table member 40 is rotatable on the shaft 50. Hereby, the refrigerator 1 according to the first embodiment of the present invention is completely assembled.

Thus, the refrigerator 1 is easily carried by the wheels 31 provided at the bottom of the base member 30, easily shows the articles stored in the storage compartments 11 of the upper cabinet 20 through the transparent table member 40 and the viewing window 16 of the upper cabinet 10, is easily used in all directions because the upper and lower cabinets 10 and 20 forming the storage compartments 11 are rotatable, and is easily used as a table by using the table member 40 rotatably provided on the upper surface of the upper cabinet 10.

Figure 5:
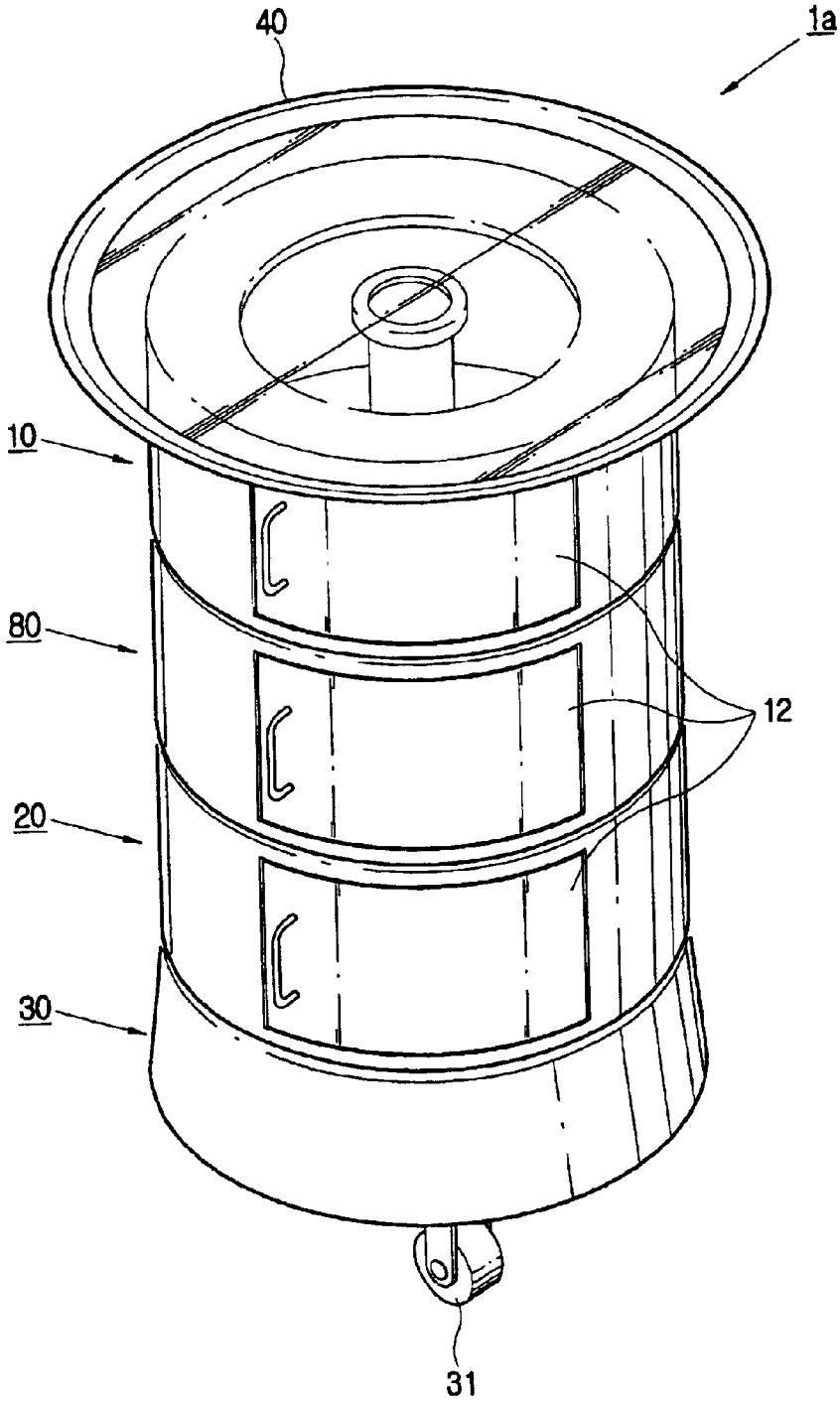
FIG. 5 is a perspective view of a refrigerator according to a second embodiment of the present invention.

FIG. 5 is a perspective view of a refrigerator according to a second embodiment of the present invention. As shown therein, differently from the first embodiment, a refrigerator 1*a* according to the second embodiment comprises a middle cabinet 80 between the first and second cabinets 10 and 20.

The middle cabinet 80 has the same configuration as the lower cabinet 20, and may be a set of middle cabinets.

With this configuration, the refrigerator 1*a* according to the second embodiment includes all the aspects of the first embodiment of the present invention and, furthermore, has an increased storage capacity.

Figure 6:
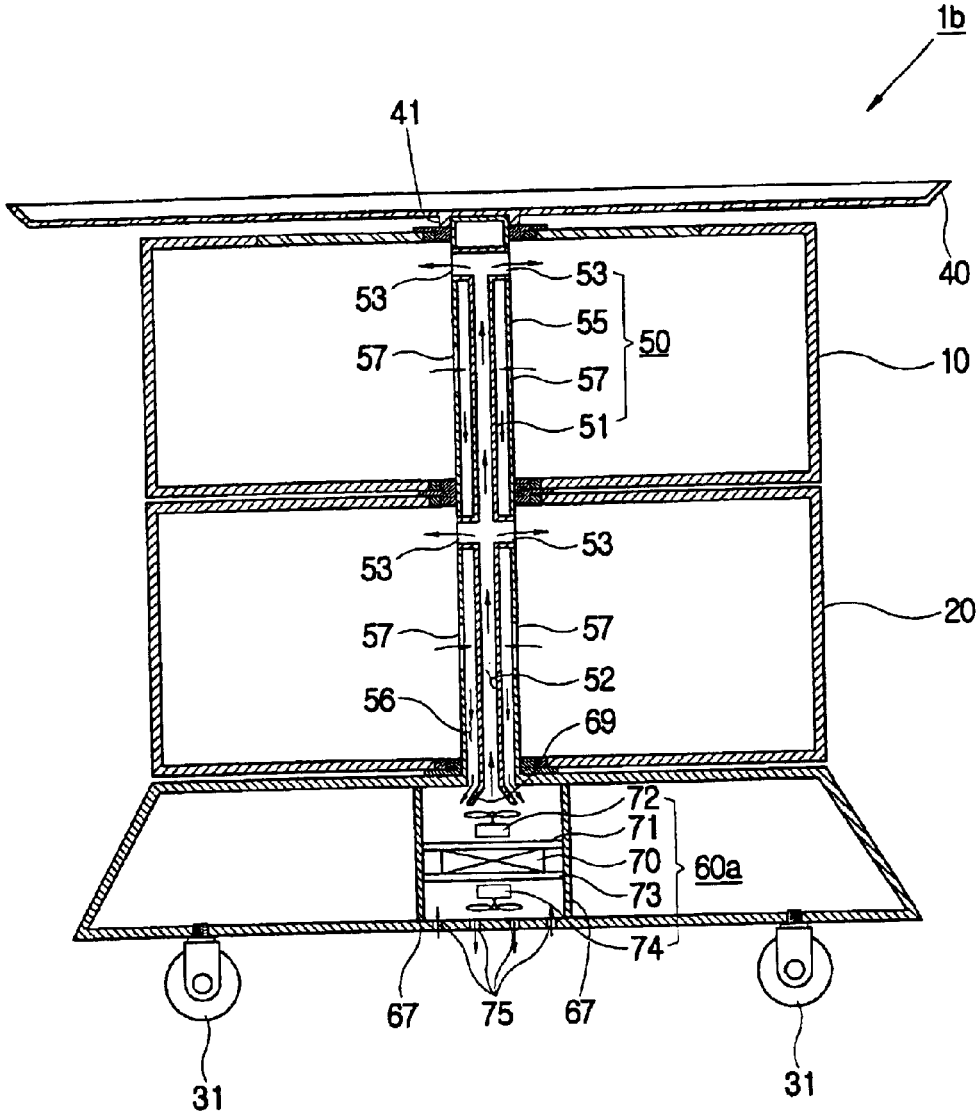
FIG. 6 is a perspective view of a refrigerator according to a third embodiment of the present invention.

FIG. 6 is a perspective view of a refrigerator according to a third embodiment of the present invention. As shown therein, differently from the above-described first and second embodiments, a refrigerator 1*b* according to the third embodiment comprises a cool air generating part 60*a* provided inside the base member 30 and including a thermoelectric semiconductor element 70.

The cool air generating part 60*a* includes a cold sink 71 disposed over the thermoelectric semiconductor element 70, and a heat sink 73 disposed under the thermoelectric semiconductor element 70. Above the cold sink 71 is provided a first cooling fan 72 to blow the cool air cooled by the cold sink 71 into the first pipe 51. Below the heat sink 73 are provided a second cooling fan 74 to blow the air from around the heat sink 73 to an outside of the refrigerator 1*b* so as to cool the heat sink 73, and a plurality of through holes 75 formed on a bottom of the base member 30 under the second cooling fan 74 so as to circulate air therethrough.

With this configuration, the refrigerator 1*b* according to the third embodiment includes the aspects of the first embodiment of the present invention and furthermore, is simpler than the first embodiment of the present invention in a structure thereof. Further, the refrigerator 1*b* according to the third embodiment operates without noise.

Figure 7:
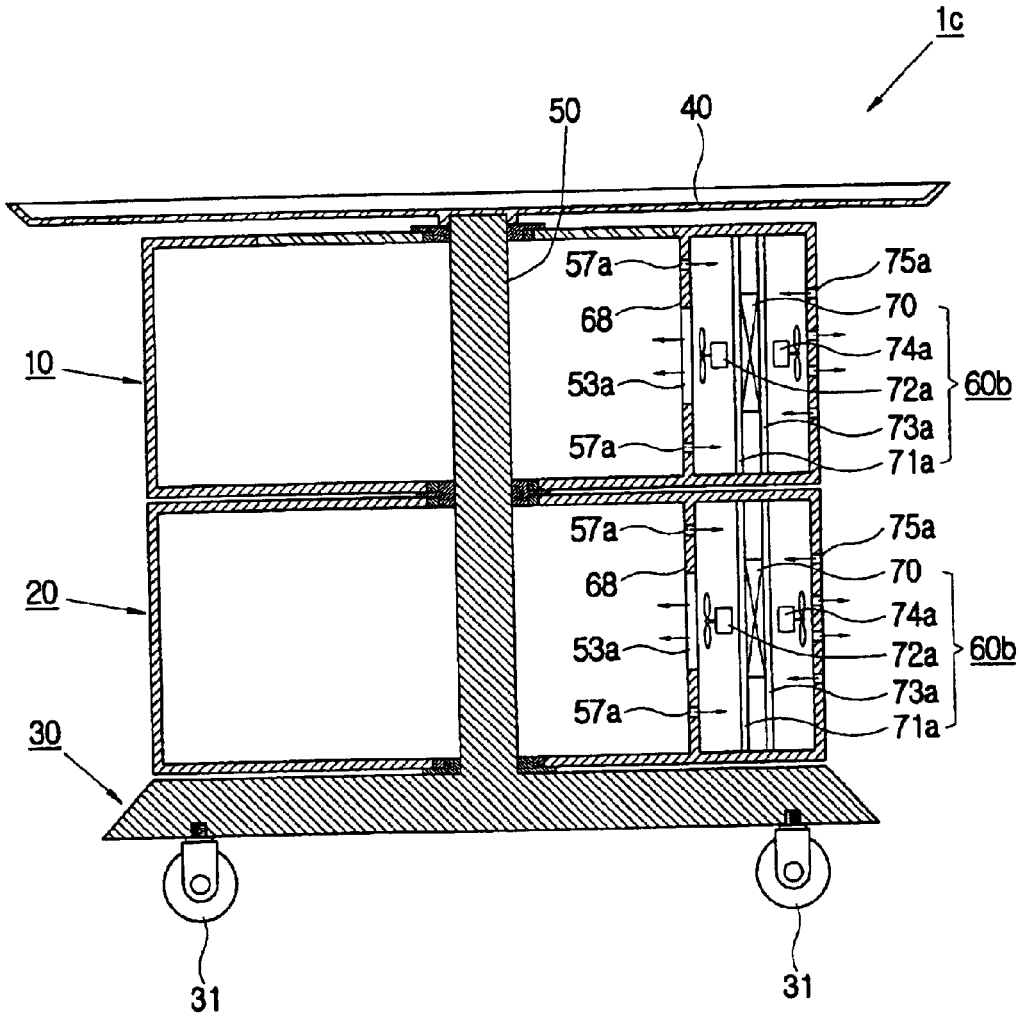
FIG. 7 is a perspective view of a refrigerator according to a fourth embodiment of the present invention.

FIG. 7 is a perspective view of a refrigerator according to a fourth embodiment of the present invention. As shown in FIG. 7, differently from the above-described first, second and third embodiments, a refrigerator 1*c* comprises the base member 30 without the cool air generating part 60 or 60*a*, and the shaft 50 without the cool air supplying passage 52, the storage air exhausting passage 55, the cool air supplying outlet 53, and the storage air exhausting outlet 57. Therefore, in the fourth embodiment, first and second cool air generating parts 60*b*, respectively, supplying the cool air to each of the storage compartments 11 are provided inside the upper and lower cabinets 10 and 20, respectively. Further, the shaft 50 is employed only to rotatably support the upper and lower cabinets 10 and 20.

Further, the first and second cool air generating parts 60*b* include a thermoelectric semiconductor element 70*a*, a cold sink 71*a* disposed in an inside toward the storage compartments relative to the thermoelectric semiconductor element 70*a*, and a heat sink 73*a* disposed in an outside away from the storage compartments 11 relative to the thermoelectric semiconductor element 70*a*. Inside of the cold sink 71*a* toward the storage compartments 11 is provided a first cooling fan 72*a* to blow cool air cooled by the cold sink 71*a* into the storage compartment 11. Outside of the heat sink 73*a* away from the storage compartments 11 is provided a second cooling fan 74*a* to blow air around the heat sink 73*a* to an outside of each of the cabinets 10 and 20 so as to cool the heat sink 73*a*. Further, inside of the first cooling fan 72*a* toward the storage compartments 11 is provided a partition wall 68 for each of the storage compartments 11 partitioning the corresponding storage compartment 11 from the cool air generating part 60*b*. The partition wall 68 corresponding to each of the cabinets is formed with an cool air supplying outlet 53*a* through which the cool air is supplied to the corresponding storage compartments 11 by the first cooling fan 72*a*, and an storage air exhausting outlet 57*a* through which the air in the corresponding storage compartments 11 is drawn into the cool air generating part 60*b*. Further, a side wall of each of the cabinets 10 and 20 disposed outside the second cooling fan 74*a* is formed with a plurality of through holes 75*a* through which the air is circulated. Further, the cool air generating part 60*b* provided inside each of the cabinets 10 and 20 is individually operable, and is individually controllable in a temperature thereof. Therefore, the upper and lower cabinets 10 and 20 can be selectively operated, as necessary, and are controllable in temperatures thereof, which may differ from each other.

With this configuration, the refrigerator 1*c* according to the fourth embodiment is simpler than the above-described first, second and third embodiments in structure. Further, in the refrigerator 1*c* according to the fourth embodiment, the storage compartments 11 are individually operable, and are individually controllable in temperature thereof.

The table member 40 is illustrated as combined to the upper end of the shaft 50 protruding through the upper surface of the upper cabinet 10. However, the table member may be incorporated with the upper surface of the upper cabinet, or the upper surface of the upper cabinet may be the table member.

The upper and lower cabinets 10 and 20 are illustrated as being shaped like a cylinder. However, the upper and lower cabinets may have a polygonal or other shape.

As described above, a refrigerator is provided which is usable in all directions by a rotatable structure, is easily carried by wheels, and is used as a table by a table member provided in an upper part of an upper cabinet.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A refrigerator comprising:

a cool air generating part supplying cool air to first and second storage compartments;

upper and lower cabinets having the first and second storage compartments, respectively, disposed therein; and a shaft, rotatably supporting the upper and lower cabinets, comprising a cool air supplying passage extending to the storage compartment of each of the cabinets, communicating with the cool air generating part to supply the cool air supplied by the cool air generating part to the storage compartment of each of the cabinets, and a storage air exhausting passage exhausting air in the storage compartment of each of the cabinets to the cool air generating part; and a base member disposed under the lower cabinet, supporting the shaft, and accommodating the cool air generating part inside the base member.

2. The refrigerator according to claim 1, further comprising:

a table member provided on an upper part of the upper cabinet.

3. The refrigerator according to claim 2, wherein the table member is rotatable relative to the upper cabinet.

4. The refrigerator according to claim 3, wherein the table member is rotatably combined to the shaft.

5. The refrigerator according to claim 1, wherein the shaft comprises:

a first pipe; and a second pipe coaxially provided around the first pipe and spaced apart from the first pipe; and one of the cool air supplying passage and the storage air exhausting passage being formed inside of the first pipe, and a remaining one being formed between the first pipe and the second pipe.

6. The refrigerator according to claim 5, wherein the shaft further comprises:

cool air supplying outlets formed through the first pipe and the second pipe to communicate with corresponding storage compartments and supplying the cool air into the corresponding storage compartments; and a storage air exhausting outlet formed on a side of the second pipe to communicate with corresponding storage compartments to exhaust the supplied cool air from the corresponding storage compartments.

7. The refrigerator according to claim 2, wherein:

the upper cabinet comprises:

a viewing window on an upper surface thereof so as to allow a view of an inside of at least one of the storage compartments; and the table member provided such that the inside of the at least one storage compartment is viewable through the viewing window.

8. The refrigerator according to claim 1, further comprising:

a plurality of wheels supporting the base member.

9. The refrigerator according to claim 1, further comprising:

at least one middle cabinet provided between the upper and lower cabinets.

10. The refrigerator according to claim 8, further comprising:

at least one middle cabinet provided between the upper and lower cabinets.

11. The refrigerator according to claim 1, wherein the cool air generating part comprises:

a thermoelectric semiconductor element provided in at least one of the cabinets.

12. A refrigerator comprising:

a cool air generating part supplying cool air to a storage compartment;

a cabinet forming the storage compartment;

a shaft, rotatably supporting the cabinet, comprising a cool air supplying passage extending to the storage compartment of the cabinets, communicating with the cool air generating part, and supplying the cool air generated by the cool air generating part to the storage compartment of the cabinet, and a storage air exhausting passage exhausting air in the storage compartment of the cabinet to the cool air generating part;

a table member provided in an upper surface of the cabinet;

a plurality of wheels supporting the cabinet; and a base member provided between the cabinet and the wheels and accommodating the cool air generating part inside the base member.

13. The refrigerator according to claim 12, wherein the table member is rotatable relative to the cabinet.

14. The refrigerator according to claim 13, wherein the cabinet is provided with a viewing window on an upper surface thereof so as to allow a view of an inside of the storage compartment; and the table member is provided such that an inside of the cabinet is viewable through the viewing window.

15. The refrigerator according to claim 14, wherein the cool air generating part comprises:

a thermoelectric semiconductor element provided inside the cabinet.

16. A refrigerator including first and second cabinets therein, comprising:

first and second storage compartments disposed in the first and second cabinets, respectively;

a cool air generating part to supply cool air to the first and second storage compartments; and a shaft, supporting the first and second cabinets and allowing the first and second cabinets, respectively, to rotate around the shaft, comprising a cool air supplying passage extending to the storage compartment of each of the cabinets, communicating with the cool air generating part, and supplying the cool air generated by the cool air generating part to the storage compartment of the cabinet, and a storage air exhausting passage exhausting air in the storage compartment of the cabinets to the cool air generating part; and a base member disposed under one of the cabinets to support the shaft and accommodating the cool air generating part inside the base member.

17. The refrigerator according to claim 16, further comprising:

a table member provided on an upper part of the one top cabinet.

18. The refrigerator according to claim 17, wherein the table member is in a disk-like shape and is larger than an upper surface of the top cabinet.

19. The refrigerator according to claim 17, wherein the table member is incorporated with an upper surface of the top cabinet, or the upper surface of the top cabinet is the table member.

20. The refrigerator according to claim 18, further comprising:

a shaft combining part formed with table member such that a bottom center of the shaft combining part is rotatably combined with an upper end of the shaft which protrudes through the upper surface of the top cabinet.

21. The refrigerator according to claim 17, wherein the table member is transparent.

22. The refrigerator according to claim 17, wherein the table member is rotatable relative to the one top cabinet.

23. The refrigerator according to claim 17, wherein the table member is stationary relative to the shaft.

24. The refrigerator according to claim 17, wherein the table member is rotatably combined to the shaft.

25. The refrigerator according to claim 16, wherein:

the supply passage comprises:

a first pipe; and the exhaust passage comprises:

a second pipe coaxially provided around the first pipe, one of the first and second pipes to allow supply air to pass from the cool air generating part to each of the storage compartments and a remaining one of the first and second pipes to allow exhaust air to pass from each of the storage compartments to the cool air generating part.

26. The refrigerator according to claim 25, wherein the shaft further comprises:

cool air supplying outlets formed through the first pipe and the second pipe to communicate with corresponding ones of the first and second storage compartments and supplying the cool air to the corresponding ones of the first and second storage compartments; and a storage air exhausting outlet formed on a side of the second pipe to communicate with corresponding ones of the first and second storage compartments and exhausting the cool air supplied to the corresponding ones of the first and second storage compartments to the cool air generating part.

27. The refrigerator according to claim 16, wherein:

the first cabinet comprises:

a viewing window on an upper surface thereof so as to allow a view of an inside of the storage compartment corresponding to the first cabinet; and the table member is provided such that the inside of the storage compartment corresponding to the first cabinet is viewable through the viewing window.

28. The refrigerator according to claim 16, further comprising:

a plurality of wheels supporting the base members.

29. The refrigerator according to claim 16, further comprising:

at least one middle cabinet provided between the first and second cabinets.

30. The refrigerator according to claim 16, wherein the at least one middle cabinet is provided with at least one middle storage compartment.

31. The refrigerator according to claim 16, wherein the cool air generating part comprises:

a thermoelectric element provided in at least one of the cabinets and of the base member.

32. The refrigerator according to claim 31, wherein the cool air generating part comprise:

a thermoelectric element;

a cold sink disposed adjacent one surface of the thermoelectric element; and a heat sink disposed adjacent another surface of the thermoelectric element.

33. The refrigerator according to claim 32, further comprising:

a first cooling fan to blow the cool air cooled by the cold sink to supply cool air to the corresponding ones of the plural storage compartments;

a second cooling fan to blow the air from around the heat sink to an outside of the refrigerator so as to cool the heat sink; and a plurality of through holes formed on a bottom of the base member adjacent to the second cooling fan so as to circulate air therethrough.

34. The refrigerator according to claim 16, wherein each of the cabinets is in a shape of a cylinder.

35. The refrigerator according to claim 16, wherein each of the cabinets is in a shape of a polygon.

36. The refrigerator according to claim 31, wherein a temperature of each of the storage compartments is individually controllable by providing the cool air generating part inside each of the cabinets.

* * * * *

UNITED STATES PATENT AND TRADEMARK OFFICE

CERTIFICATE OF CORRECTION

PATENT NO. : 6,990,828 B2
APPLICATION NO. : 10/645845
DATED : January 31, 2006
INVENTOR(S) : Yoon-young Kim et al.

It is certified that error appears in the above-identified patent and that said Letters Patent is hereby corrected as shown below:

Column 10, line 14, Claim 28, replace "members" with --member--.

Signed and Sealed this

Twenty-fifth Day of July, 2006

JON W. DUDAS
*Director of the United States Patent and Trademark Office*